US005880062A

United States Patent [19]

Sanders et al.

[11] Patent Number: 5,880,062

[45] Date of Patent: Mar. 9, 1999

[54] INK JET PRINTING PROCESS FOR DESENSITIZING CARBONLESS PAPER

[75] Inventors: David J. Sanders, Oakville; Francoise M. Winnik, Toronto; Marcel P. Breton, Mississauga, all of Canada

[73] Assignee: Xerox Corporation, Stamford, Conn.

[21] Appl. No.: 78,533

[22] Filed: Jun. 16, 1993

[51] Int. Cl.[6] ..... B41M 5/128

[52] U.S. Cl. ..... 503/201; 347/56; 347/98; 347/105; 427/152; 503/205; 503/206

[58] Field of Search ..... 503/205, 206, 503/201, 203; 347/98, 56, 105; 427/150, 152

[56] References Cited

U.S. PATENT DOCUMENTS

| | | | |
|---|---|---|---|
| 2,777,780 | 1/1957 | Cormack et al. | 117/36 |
| 3,809,668 | 5/1974 | Yarian | 260/33.4 |
| 3,852,094 | 12/1974 | Yarian | 117/36.8 |
| 4,007,310 | 2/1977 | Miyamoto et al. | 503/205 |
| 4,109,047 | 8/1978 | Fredrickson | 503/205 |
| 5,156,675 | 10/1992 | Breton et al. | 106/22 |
| 5,174,556 | 12/1992 | Taylor et al. | 270/1.1 |
| 5,271,765 | 12/1993 | Ma | 106/22 D |

FOREIGN PATENT DOCUMENTS

| | | |
|---|---|---|
| 2727194 | 12/1977 | Germany . |
| 3-71882 | 3/1991 | Japan . |
| 2032932 | 5/1980 | United Kingdom . |

*Primary Examiner*—Pamela R. Schwartz
*Attorney, Agent, or Firm*—Judith L. Byorick

[57] ABSTRACT

Disclosed is a printing process which comprises (a) incorporating into a printing apparatus capable of generating ink jet images a carbonless paper set comprising a first sheet, a second sheet, and optional intermediate sheets situated between the first sheet and second sheet, wherein the first sheet comprises paper coated on one surface with a color former and the second sheet comprises paper coated on one surface with a color developer, and wherein, when the carbonless paper set is assembled, the surface of the first sheet coated with the color former is in contact with the surface of a sheet coated with the color developer and the surface of the second sheet coated with the color developer is in contact with the surface of a sheet coated with the color former; (b) incorporating into the printing apparatus an ink jet ink comprising water, an organic component, and a desensitizing agent capable of interacting either (i) with the color former so that the color former's subsequent ability to interact with the color developer is reduced, or (ii) with the color developer so that the color developer's subsequent ability to interact with the color former is reduced; and (c) causing droplets of the ink containing the desensitizing agent to be ejected in an imagewise pattern onto either (i) at least one surface of one sheet coated with the color former, or (ii) at least one surface of one sheet coated with the color developer.

20 Claims, No Drawings

INK JET PRINTING PROCESS FOR DESENSITIZING CARBONLESS PAPER

BACKGROUND OF THE INVENTION

The present invention is directed to ink jet printing processes on carbonless paper. More specifically, the present invention is directed to processes for selectively desensitizing areas of carbonless paper by the application of a desensitizing agent via an ink jet printing process. One embodiment of the present invention is directed to a printing process which comprises (a) incorporating into a printing apparatus capable of generating ink jet images a carbonless paper set comprising a first sheet, a second sheet, and optional intermediate sheets situated between the first sheet and second sheet, wherein the first sheet comprises paper coated on one surface with a color former and the second sheet comprises paper coated on one surface with a color developer, and wherein, when the carbonless paper set is assembled, the surface of the first sheet coated with the color former is in contact with the surface of a sheet coated with the color developer and the surface of the second sheet coated with the color developer is in contact with the surface of a sheet coated with the color former; (b) incorporating into the printing apparatus an ink jet ink comprising water, an organic component, and a desensitizing agent capable of interacting either (i) with the color former so that the color former's subsequent ability to interact with the color developer is reduced, or (ii) with the color developer so that the color developer's subsequent ability to interact with the color former is reduced; and (c) causing droplets of the ink containing the desensitizing agent to be ejected in an imagewise pattern onto either (i) at least one surface of one sheet coated with the color former, or (ii) at least one surface of one sheet coated with the color developer.

Carbonless paper sets generally are stacks of at least two sheets of paper wherein the application of pressure in imagewise fashion on the top sheet, typically by handwriting or typing, results in formation of a corresponding image on the underlying sheets, so that copies are formed as the image is generated on the top sheet. Carbonless paper sets typically comprise a top sheet of paper, on the bottom surface of which is coated a first composition, and a bottom sheet, on the top surface of which is coated a second composition. The first and second compositions are in contact with each other when the top and bottom sheets are placed in stack formation, and generally are of a nature such that application of pressure to the top sheet of the stack at a specified location causes interaction between the first and second compositions that results in the formation of a colored area on the bottom sheet at the location at which pressure was applied. Intermediate sheets can be located between the top and bottom sheets, wherein each intermediate sheet is coated on its top surface with the second composition and on its bottom surface with the first composition; application of pressure to the top sheet then results in the formation of a colored area at the location at which pressure was applied on each of the intermediate sheets and on the bottom sheet.

An example of a carbonless paper set is disclosed in U.S. Pat. No. 3,843,383, the disclosure of which is totally incorporated herein by reference. This patent discloses a recording sheet comprising a support having thereon a layer of color developer capable of reacting with a substantially colorless color former to form colored images. The paper set generally comprises a top sheet coated with microcapsules containing a color former solution, a bottom sheet coated with a color developer material in a binder, and, in some instances, middle sheets coated on one side with the color developer and on the other side with the color former microcapsules. Alternatively, the color former microcapsules and the color developer can be applied to the same surface of a paper. The color developer comprises a clay into which is incorporated at least one aromatic carboxylic acid or alkali metal salt thereof, and, optionally, acidic resins or inorganic pigments such as metal oxides, metal hydroxides, or metal carbonates. Suitable clays include acidic clay, active clay, attapulgite, zeolite, bentonite, kaolin, silicic acid, synthetic silicic acid, aluminum silicate, zinc silicate, colloidal silicic acid, and the like. The clay and the aromatic carboxylic acid or alkali metal salt thereof are formed into a coating solution which is then applied to paper. The color former is dissolved in a solvent and encapsulated in microcapsules, or is dissolved in a solvent and mixed with a binder. Contacting a sheet coated with microcapsules containing the color former under pressure with a sheet coated with the color developer results in formation of a color image. Other patents disclosing carbonless paper of this type include U.S. Pat. No. 2,712,507 and U.S. Pat. No. 2,730,456, the disclosures of which are totally incorporated herein by reference. Alternatively, as disclosed in U.S. Pat. No. 2,730,457, the disclosure of which is totally incorporated herein by reference, the color former microcapsules and the color developer of a carbonless paper can be applied to the same surface of a paper sheet. Other configurations of color former, color developer, and a pressure-releasable liquid solvent are possible, including, for example, those disclosed in U.S. Pat. No. 3,672,935, the disclosure of which is totally incorporated herein by reference. Additional patents disclosing carbonless papers and materials suitable for carbonless paper applications include U.S. Pat. No. 2,417,897, U.S. Pat. No. 3,672,935, U.S. Pat. No. 3,681,390, U.S. Pat. No. 4,202,820, U.S. Pat. No. 4,675,706, U.S. Pat. No. 3,481,759, U.S. Pat. No. 4,334,015, U.S. Pat. No. 4,372,582, U.S. Pat. No. 4,334,015, U.S. Pat. No. 2,800,457, U.S. Pat. No. 2,800,458, U.S. Pat. No. 3,418,250, U.S. Pat. No. 3,516,941, U.S. Pat. No. 4,630,079, U.S. Pat. No. 3,244,550, U.S. Pat. No. 3,672,935, U.S. Pat. No. 3,732,120, U.S. Pat. No. 3,843,383, U.S. Pat. No. 3,934,070, U.S. Pat. No. 3,481,759, U.S. Pat. No. 3,809,668, U.S. Pat. No. 4,877,767, U.S. Pat. No. 4,857,406, U.S. Pat. No. 4,853,364, U.S. Pat. No. 4,842,981, U.S. Pat. No. 4,842,976, U.S. Pat. No. 4,788,125, U.S. Pat. No. 4,772,532, and U.S. Pat. No. 4,710,570, the disclosures of each of which are totally incorporated herein by reference.

Frequently carbonless paper sets are printed as forms, wherein a large number of sets are printed with standard text or other material, leaving blank areas for individualized information to be filled in by, for example, impact typewriting or handwriting. Typically, carbonless pre-printed forms are generated by techniques such as offset printing. Offset printing and other large scale printing processes, however, require complex and expensive equipment which is not generally found in an office or small business environment. Thus, one desiring forms printed on carbonless paper generally must order them from a professional printer, thus generating added costs and inconvenience, particularly when only a relatively small number of the pre-printed forms are needed. The ability to generate pre-printed carbonless forms on standard office equipment thus can be desirable, particularly when small quantities of forms are desired.

In some instances, it may be desirable to desensitize selected areas of selected sheets of carbonless paper so that not all of the information written on a finished carbonless paper set (by, for example, handwriting or impact printing) appears on all of the carbonless copies. For example, in a multi-part invoice or receipt, some of the information recorded on some of the copies retained by the issuing company may be proprietary, and thus should not appear on the copies which are given to the customer. Previously, it has been possible to "block" or desensitize selected parts of forms printed by offset methods by printing those parts with a desensitizing ink during the offset printing of the carbonless sheets. This desensitizing offset ink reacts with the color developer to form a colorless product. When the carbonless paper set is subsequently subjected to handwriting or impact printing, microcapsules containing color former are broken in an imagewise pattern and the color former solution transfers to the color developer coating and reacts with the developer to form a colored image. In the desensitized areas, however, the color developer has already reacted with the desensitizing ink to form a colorless compound, and no color forming reaction can occur in these areas to form a carbonless image.

Known desensitizing processes, however, require the use of offset printing techniques. Thus, the desensitizing of selected areas of carbonless forms is not easily done in an office setting with common office or small business equipment. Accordingly, a process which would enable both printing and selective desensitization of carbonless papers in an office environment would be highly desirable.

Ink jet printing systems generally are of two types: continuous stream and drop-on-demand. In continuous stream ink jet systems, ink is emitted in a continuous stream under pressure through at least one orifice or nozzle. The stream is perturbed, causing it to break up into droplets at a fixed distance from the orifice. At the break-up point, the droplets are charged in accordance with digital data signals and passed through an electrostatic field which adjusts the trajectory of each droplet in order to direct it to a gutter for recirculation or a specific location on a recording medium. In drop-on-demand systems, a droplet is expelled from an orifice directly to a position on a recording medium in accordance with digital data signals. A droplet is not formed or expelled unless it is to be placed on the recording medium.

Since drop-on-demand systems require no ink recovery, charging, or deflection, the system is much simpler than the continuous stream type. There are two types of drop-on-demand ink jet systems. One type of drop-on-demand system has as its major components an ink filled channel or passageway having a nozzle on one end and a piezoelectric transducer near the other end to produce pressure pulses. The other type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble. The ink at the orifice is forced out as a propelled droplet as the bubble expands. When the hydrodynamic motion of the ink stops, the process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have substantially the same high speed printing capability.

The operating sequence of the bubble jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble formation or nucleation of around 280° C. Once nucleated, the bubble or water vapor thermally isolates the ink from the heater and no further heat can be applied to the ink. This bubble expands until all the heat stored in the ink in excess of the normal boiling point diffuses away or is used to convert liquid to vapor, which removes heat due to heat of vaporization. The expansion of the bubble forces a droplet of ink out of the nozzle, and once the excess heat is removed, the bubble collapses on the resistor. At this point, the resistor is no longer being heated because the current pulse has passed and, concurrently with the bubble collapse, the droplet is propelled at a high rate of speed in a direction towards a recording medium. The resistive layer encounters a severe cavitational force by the collapse of the bubble, which tends to erode it. Subsequently, the ink channel refills by capillary action. This entire bubble formation and collapse sequence occurs in about 10 microseconds. The channel can be refired after 100 to 500 microseconds minimum dwell time to enable the channel to be refilled and to enable the dynamic refilling factors to become somewhat dampened. Thermal ink jet processes are well known and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference.

U.S. Pat. No. 2,777,780 (Cormack et al.), the disclosure of which is totally incorporated herein by reference, discloses a method of deactivating portions of record material sensitized with minute particles of inorganic adsorbent electron acceptor materials which cause the formation of color in an electron donor aromatic double bond color-reactant compound adsorbed thereon, by reason of an electron donor-acceptor color reaction which converts the compound to a more highly polarized conjugated form, giving it a distinctive color, including the step of applying to selected areas of the sensitized record material, before any of the organic color-reactant is applied, highly polar, non-volatile non-color-forming adsorbate material sufficient to occupy the normally available adsorbent sites on the particles of such areas. This reference discloses the desensitizing of electron acceptor color developer coatings with cationic quaternary ammonium salts, higher aliphatic or aryl amine acetates, high molecular weight primary amines and primary diamines such as dodecyl amine or dodecyl diamine, or substituted oxazolines.

U.S. Pat. No. 3,809,668 (Yarian) and U.S. Pat. No. 3,852,094 (Yarian), the disclosures of each of which are totally incorporated herein by reference, disclose desensitizing agents which, when combined with a suitable solvent, can be used to desensitize carbonless papers of the DTO/metal type wherein the DTO (Dithiooxamide) compound is encapsulated and is released for chemical interaction with a coreactant metal salt by rupture of the capsules. The preferred desensitizing agents are partial esters of ethylenediaminetetraacetic acid, which partial esters are soluble in suitable organic media and form stable, substantially colorless complexes with, for example, nickel salts. Various homologs and analogs of these partial ester derivatives are also operative in the invention, as are certain less preferred compounds, i.e., certain diamines, oximes, and vic.- dimercaptans. The preferred desensitizing agents are also useful for desensitizing carbonless papers of the leuco dye/acidic clay type.

U.S. Pat. No. 5,174,556 (Taylor et al.), the disclosure of which is totally incorporated herein by reference, discloses a document finisher which includes a printing station for printing on the binding of a book. The printing station in one embodiment prints on the binder tape before the book is bound. In a second embodiment, the printer prints on the binding after the book is bound. The printing stations are space efficient and designed to be easily incorporated with preexisting stations in document finishers. Ink jet printers and impact-type printer may be utilized.

U.S. Pat. No. 5,156,675 (Breton et al.), the disclosure of which is totally incorporated herein by reference, discloses fast drying ink compositions containing a colorant, a dye, water and a cosolvent. Some of the ink compositions dry in less than about 1 second and have a viscosity of between about 1.6 and about 2.5 centipoise and a specified surface tension. Some of the ink compositions contain specified cosolvents, preferably a mixture of diethylene glycol monobutyl ether and glycerol.

British Patent Application 2,030,932, the disclosure of which is totally incorporated herein by reference, discloses a copying paper having a color developing acidic material layer for developing color when contacted with a colorless dye which can be sufficiently desensitized on a portion which is not desired to be given an image by printing on the portion a desensitizing ink composition. The ink comprises a poly(oxypropylene)glycol or triol, a copolymer thereof with polyoxyethylene, an aliphatic alcohol or a phenol adduct thereof, or a carboxylic acid ester thereof, a pigment and a vehicle therefor according to dry lithography.

Japanese Patent Publication 91-71882, the disclosure of which is totally incorporated herein by reference, discloses a desensitizing agent for pressure-sensitive copying which is an aminostyrene polymer graft polymerized at the amino group by ethylene oxide, propylene oxide, or styrene oxide.

German Patent 2,727,194, the disclosure of which is totally incorporated herein by reference, discloses a desensitizer for carbonless copy paper which are hardenable by UV radiation.

U.S. Pat. No. 5,286,286 entitled "Colorless Fast-Drying Ink Compositions for Printing Concealed Images Detectable by Fluorescence," with the named inventors Francoise M. Winnik, Anthony R. Davidson, and Marcel P. Breton, the disclosure of which is totally incorporated herein by reference, discloses an ink composition consisting essentially of water, diethylene glycol-monobutyl ether, glycerol, an optional cyclohexyl pyrrolidinone component, a dye selected from the group consisting of dyes containing dansyl chromophores and dyes containing porphyrin chromophores, an optional biocide, and an optional polyalkylene oxide/bisphenol-A additive.

Copending application U.S. Ser. No. 07/616,971, filed Nov. 21, 1990, entitled "Carbonless Paper for Ink Jet Printing," with the named inventors John F. Oliver, Richard E. Sandborn, and David J. Sanders, now abandoned, the disclosure of which is totally incorporated herein by reference, discloses a process for generating images which comprises incorporating into an ink jet printing apparatus a carbonless paper set which comprises a first sheet comprising a support containing a color developer capable of reacting with a color former to produce a color image, said color developer comprising high surface area silica particles, and a second sheet comprising a support coated with the color former, forming an image on the first sheet by causing ink to be expelled in droplets on a surface containing the color developer, and forming an image on the second sheet by causing ink to be expelled in droplets onto the surface opposite to that coated with the color former.

U.S. Pat. No. 5,212,040, entitled "Carbonless Paper for Electrostatic Imaging Processes," with the named inventors David J. Sanders, John F. Oliver, and Marcel P. Breton, the disclosure of which is totally incorporated herein by reference, discloses a process which comprises incorporating into an electrostatic imaging apparatus a recording sheet comprising a support on one surface of which are situated microcapsules which comprise a shell and a core containing a color former and an oil, said microcapsules being strengthened with a polymer capable of degrading upon exposure to actinic radiation; generating an electrostatic latent image on an imaging member in the apparatus; developing the latent image with a developer; transferring the developed image to the recording sheet; and, subsequent to transfer, exposing the recording sheet to actinic radiation at a wavelength at which the polymer will degrade, thereby rendering the microcapsules subject to rupture upon application of pressure.

U.S. Pat. No. 5,223,475, entitled "Self-Cleaning Carbonless Paper," with the named inventors John F. Oliver and David J. Sanders, the disclosure of which is totally incorporated herein by reference, discloses a carbonless paper set having at least two sheets, wherein a first sheet comprises paper coated on one surface with a color former and a second sheet comprises paper coated on one surface with a color developer, and wherein at least one of the sheets contains an oleophilic pigment filler material on the surface of the sheet opposite to that coated with the color former or color developer. Also disclosed is a process for generating images which comprises generating an electrostatic latent image on an imaging member in an imaging apparatus, developing the latent image with toner particles of one polarity, contacting the developed image on the imaging member with the first sheet of the carbonless paper set disclosed herein, applying an electric charge of a polarity opposite to that of the toner particles to the surface of the first sheet opposite the surface in contact with the imaging member, thereby transferring the developed image to the first sheet, generating an electrostatic latent image on the imaging member in the imaging apparatus, developing the latent image with toner particles of one polarity, contacting the developed image on the imaging member with the second sheet of the carbonless paper set disclosed herein, applying an electric charge of a polarity opposite to that of the toner particles to the surface of the second sheet opposite the surface in contact with the imaging member, thereby transferring the developed image to the second sheet, and optionally permanently affixing the transferred images to the first and second sheets.

U.S. Pat. No. 5,373,350, entitled "Xerographic/Thermal Ink Jet Combined Printing," with the named inventors Thomas N. Taylor, LeRoy A. Baldwin, and Otto R. Dole, the disclosure of which is totally incorporated herein by reference, discloses a printer which combines the technologies of xerographic and thermal ink jet printing into a unit capable of high resolution text and color graphics. The printer is capable of forming a composite image, including a xerographic printing portion and a thermal ink jet (TIJ) printing portion, by printing the xerographic portion using known xerographic techniques and the thermal ink jet portion by a thermal ink jet printing array associated with the printer. The portions may be printed in any order, and may be dried by a drying station after printing of each portion or after both portions have been printed. At least one thermal ink jet printing array can serve as an annotator which is capable of printing additional information onto a copy, such as company letterhead, special instructions, addresses, or the like.

Accordingly, while known materials and processes are suitable for their intended purposes, a need remains for processes for desensitizing selected areas of selected carbonless paper sheets. In addition, a need remains for processes for desensitizing selected areas of selected carbonless paper sheets which can be carried out with equipment commonly found in office and small business environments. Further, there is a need for processes for both printing and selectively desensitizing carbonless paper sheets which can be carried out with equipment commonly found in office and small business environments. Additionally, a need exists for processes for rapidly printing and selectively desensitizing carbonless paper sheets by methods such as electrophotography, electrography, ionography, ink jet printing, or the like. There is also a need for processes for both printing and desensitizing carbonless paper sheets which can be carried out in an apparatus which enables printing of images via an electrophotographic, electrographic, ionographic, or ink jet processes and annotation of the images via an ink jet printing process.

SUMMARY OF THE INVENTION

It is an object of the present invention to provide printing processes with the above-noted advantages.

It is another object of the present invention to provide processes for desensitizing selected areas of selected carbonless paper sheets.

It is yet another object of the present invention to provide processes for desensitizing selected areas of selected carbonless paper sheets which can be carried out with equipment commonly found in office and small business environments.

It is still another object of the present invention to provide processes for both printing and selectively desensitizing carbonless paper sheets which can be carried out with equipment commonly found in office and small business environments.

Another object of the present invention is to provide processes for rapidly printing and selectively desensitizing carbonless paper sheets by methods such as electrophotography, electrography, ionography, ink jet printing, or the like.

Yet another object of the present invention is to provide processes for both printing and desensitizing carbonless paper sheets which can be carried out in an apparatus which enables printing of images via an electrophotographic, electrographic, Monographic, or ink jet processes and annotation of the images via an ink jet printing process.

These and other objects of the present invention (or specific embodiments thereof) can be achieved by providing a printing process which comprises (a) incorporating into a printing apparatus capable of generating ink jet images a carbonless paper set comprising a first sheet, a second sheet, and optional intermediate sheets situated between the first sheet and second sheet, wherein the first sheet comprises paper coated on one surface with a color former and the second sheet comprises paper coated on one surface with a color developer, and wherein, when the carbonless paper set is assembled, the surface of the first sheet coated with the color former is in contact with the surface of a sheet coated with the color developer and the surface of the second sheet coated with the color developer is in contact with the surface of a sheet coated with the color former; (b) incorporating into the printing apparatus an ink jet ink comprising water, an organic component, and a desensitizing agent capable of interacting either (i) with the color former so that the color former's subsequent ability to interact with the color developer is reduced, or (ii) with the color developer so that the color developer's subsequent ability to interact with the color former is reduced; and (c) causing droplets of the ink containing the desensitizing agent to be ejected in an imagewise pattern onto either (i) at least one surface of one sheet coated with the color former, or (ii) at least one surface of one sheet coated with the color developer.

DETAILED DESCRIPTION OF THE INVENTION

The process of the present invention entails applying an ink jet ink capable of desensitizing carbonless paper to selected areas of selected sheets of carbonless paper in an imagewise fashion via an ink jet printing process. Typically, the sheets of the carbonless paper set are incorporated into the printing apparatus prior to being assembled into a carbonless paper stack. The sheets include a first sheet coated with a color former, a second sheet coated with a color developer, and, optionally, intermediate sheets situated between the first and second sheets, said intermediate sheets being coated on one surface with the color former and on the other surface with the color developer. In areas of each sheet where it is desired to desensitize the color former/color developer combination so that the ability to form carbonless images in that area of the paper by application of pressure is reduced or eliminated, the desensitizing ink is applied in imagewise fashion to either the color former coating or the color developer coating. Subsequently, after the carbonless paper set has been assembled into a stack, application of pressure to the stack in areas where the color former or color developer has been printed with the desensitizing ink will result in either only a faint image or no image at all being formed, since the interaction between the desensitizing ink and the color former or color developer inhibits or prevents subsequent interaction between the color former and the color developer to form a visible image.

The color formers generally comprise a binder plus microcapsules containing a color forming material dissolved in a suitable solvent. In general, the color forming material can be either a substantially colorless basic dye precursor, or an organic complexing agent, or a combination of the two. The color forming material may be a colorless basic dye precursor such as, for example, benzoyl leuco methylene blue; diaryl phthalides such as 3,3-bis (4-dimethylaminophenyl)-6-dimethylaminophthalide (Crystal Violet Lactone) and 3,3-bis (4-dimethylaminophenyl) phthalide (Malachite Green Lactone); other phenyl-, indolpyrrol-, and carbazol- substituted phthalides; leucauramines; acyl auramines; unsaturated aryl ketones; basic mono azo dyes; Rhodamine B Lactams; polyaryl carbinols; nitro-, amino-, amido-, sulfon amido-, aminobenzylidene-, halo-, and anilino- substituted fluorans, such as 3-diethylamino-6-methyl-7-anilinofluoran; spirodipyrans; pyridine and pyrazine compounds; or the like. Examples of colorless basic dye precursors are disclosed in U.S. Pat. No. 2,417,897, U.S. Pat. No. 3,672,935, U.S. Pat. No. 3,681,390, U.S. Pat. No. 4,202,820, and U.S. Pat. No. 4,675,706, the disclosures of which are totally incorporated herein by reference. The color forming material may also be an organic complexing agent. Examples of organic complexing agents include those listed in U.S. Pat.

No. 3,481,759, U.S. Pat. No. 4,334,015, and U.S. Pat. No. 4,372,582, the disclosures of which are totally incorporated herein by reference. Examples of organic complexing agents include dithiooxamide and its derivatives such as N,N'-dibenzyl-dithiooxamide, N,N'-bis(2-octanlyloxyethyl) dithiooxamide, and di-dodecyl dithiooxamide; aromatic substituted hydrazones such as those disclosed in U.S. Pat. No. 4,334,015 or the like.

Typically the chosen color former material, or combination of color former materials, is dissolved in a suitable organic solvent and encapsulated in a hard polymeric shell by one of several known encapsulation techniques. Examples of suitable solvents include alkyl biphenyls such as propylbiphenyl and butylbiphenyl; dialkyl phthalates such as diethylphthalate, dibutylphthalate, dioctylphthalate, dinonylphthalate, and ditridecylphthalate; alkylated naphthalenes such as dipropyinaphthalene; $C_{10}$–$C_{14}$ alkyl benzenes such as dodecyl benzene; alkyl or aralkyl benzoates such as benzyl benzoate; benzylxylene; benzylbutylphthalate; ethyidiphenylmethane; 2,2,4-trimethyl-1,3-pentanediol diisobutyrate; partially hydrogenated terphenyls; cyclohexane; toluene; 3-heptanone; tributyl phosphate; and mixtures of the above. The solvents for the color former can include any of the above which possess sufficient solubility for the color former. A suitable solvent should be capable of dissolving at least about 1 percent by weight and preferably from about 2 to about 10 percent by weight of the color former. In the case of a basic dye precursor/acidic polymer developer system, or an organic complexing agent/transition metal salt system, the color former solvent preferably is also a cosolvent for the color developer material to promote the color forming reaction. Of course, a suitable solvent must also be a non-solvent for the chosen microcapsule wall material.

Minute droplets of color former solution are produced by emulsifying the solvent oil in an aqueous medium. The color former solution droplets can then be encapsulated in a polymeric shell by any one of a number of known microencapsulation techniques, such as coacervation, complex coacervation, interfacial polymerization, in-situ polymerization, or the like. Methods for encapsulating minute droplets of color former solution in a polymeric shell are described in, for example, U.S. Pat. No. 2,800,457, U.S. Pat. No. 2,800,458, U.S. Pat. No. 3,418,250, and U.S. Pat. No. 3,516,941, the disclosures of each of which are totally incorporated herein by reference. Capsule wall forming materials include but are not limited to gelatin wall formers such as gum arabic, polyvinyl alcohol, and carboxymethylcellulose; isocyanate wall-formers; urea-formaldehyde and urea-resorcinol-formaldehyde; melamine-formaldehyde; polyurea; polyurethane; polyamide; polyester; and the like. The completed microcapsules are typically from about 1 to about 50 microns and preferably from about 5 to about 10 microns in diameter. The capsule fill of color former in solvent typically comprises from about 50 to about 95 percent of the total capsule weight.

A coating formulation is prepared by mixing an aqueous dispersion of microcapsules containing color former solution with an aqueous dispersion of a suitable binder, such as starch, polyvinyl alcohol, latex, or the like with a capsule:binder ratio typically being from about 9:1 to about 7:3. The capsule plus binder dispersion is then coated onto a paper support using any one of a number of known paper coating techniques, such as roll, gravure, air-knife, blade, rod, or slot die coating, although methods that minimize capsule breakage, such as roll and air-knife, are preferred.

Optionally, the color former coating can also include from about 5 to about 10 percent by weight of particles of somewhat larger size than the microcapsules. For example, as disclosed in U.S. Pat. No. 4,630,079, the disclosure of which is totally incorporated herein by reference, the color former coating contains particles of somewhat larger size than the microcapsules to prevent or reduce accidental or premature breakage of the microcapsules. Such particles typically comprise fine powders of cellulose, starch granules, or various types of plastic beads. Dry coat weights for the color former coating typically range from about 2 to about 10 grams per square meter, which typically includes from about 1 to about 5 grams per meter of solvent and from about 0.01 to about 0.1 grams per square meter of color former, with the balance comprising binder, capsule material, and any other ingredients in the coating.

Conventional carbonless paper technology typically employs one of two approaches. In the first, the color former is a colorless precursor dye which becomes colored upon contact with the relatively acidic surface of the color developer. One example of a commercially available carbonless paper employing this approach is the NCR brand of carbonless paper manufactured by Appleton Papers Inc., Appleton, Wis. For a basic dye precursor color former, the corresponding color developer generally comprises an acidic developer material. Acidic color developers may be inorganic pigments such as acidic clay, active clay, attapulgite, zeolite, bentonite, kaolin, silicic acid, synthetic silicic acid, aluminum silicate, zinc silicate, and the like; organic acids such as tannic acid, gallic acid, benzoic acid, propyl gallate, and bisphenol-A; acidic polymers such as phenolic resins, including phenol-aldehyde polymers, phenol-acetylene polymers, and rosin maleate resin; aromatic carboxylic acids such as salicylic acid and its derivatives; metal salts of aromatic carboxylic acids such as zinc salicylate; zinc-chelated phenolic resins; oil soluble metal salts of phenol-formaldehyde resins; and combinations of the above. To produce the bottom sheet of a carbonless paper set, solid particles of the color developer material are mixed with a suitable binder such as latex, polyvinyl alcohol, starch, gum arabic, or other film-forming material, and coated on the top of a paper support. The acidic color developer material may also be mixed with neutral inorganic pigments such as various clays or calcium carbonate, along with a suitable binder to form the color developer coating. In the case of an inorganic acidic developer material, a coating formulation is prepared by mixing an aqueous dispersion of the acid clay with a suitable binder such as starch, polyvinyl alcohol, or latex, with a clay:binder ratio typically between about 9:1 and about 6:4. This mixture can be coated onto a paper support by any of a number of known techniques, including roll, gravure, air-knife, blade, slot die, or the like. In the case of an organic acidic color developer material, it may be dissolved or dispersed in a suitable organic solvent vehicle to form a printing ink that can be coated on a paper support by any of a number of known techniques. Alternately, the organic acidic developer material may be ground into fine particle form, to furnish a large reactant surface per unit area for the color former, and mixed in an aqueous dispersion with a suitable binder, with particle:binder ratios typically between about 9:1 and about 6:4, and coated on a paper support by any of a number of known techniques. Additionally, fine particles of organic acidic color developer may be mixed with a neutral inorganic pigment such as various clays or calcium carbonate to promote absorption of the color former solution, and dispersed in an aqueous medium with suitable binders, with typical acid resin:pigment:binder ratios of 15:75:10, and coated on a paper support by any of a number of known techniques. Acidic color developers are disclosed in, for example, U.S. Pat. No. 3,244,550, U.S. Pat. No. 3,672,935, U.S. Pat. No. 3,732,120, U.S. Pat. No. 3,843,383, and U.S. Pat. No. 3,934,070, the disclosures of each of which are totally incorporated herein by reference.

In the second approach, the color former is a colorless material that forms a colored metal complex upon contacting the color developer surface. One example of a commercially available carbonless paper employing this approach is 3M Tartan, available from the Minnesota Mining and Manufacturing Company, St. Paul, Minn. For an organic complexing agent color former, the corresponding color developer generally comprises a salt of a transition metal such as Ni, Cu, Co, or Zn. Examples of transition metal salts for color developers include nickel 2-ethylhexoate and nickel rosinate. A color developer sheet may be produced by adding to the initial paper pulp slurry a water soluble rosin salt such as sodium rosinate, along with a water soluble metal salt such as nickel sulphate, which causes an insoluble metal rosinate, i.e. nickel rosinate, to be precipitated as a sizing on the paper fibers. The treated fibers are then formed into a paper sheet by conventional papermaking techniques. Alternately, an aqueous dispersion of nickel rosinate may be coated on the surface of a paper support by any of a number of known techniques. Additionally, a transition metal salt such as nickel 2-ethylhexoate may be combined in an aqueous dispersion with an inorganic pigment such as various clays or aluminum oxide, along with suitable binders, and coated on a paper support by any of a number of known techniques. To produce the bottom sheet of a carbonless paper set, the transition metal salt is mixed with an inorganic pigment such as various clays, along with a suitable binder, and coated on the top of a paper support. Transition metal color developers are disclosed in U.S. Pat. No. 3,481,759, U.S. Pat. No. 3,809,668, and U.S. Pat. No. 4,334,015, the disclosures of which are totally incorporated herein by reference. As disclosed in U.S. Pat. No. 4,372,582, the disclosure of which is totally incorporated herein by reference, if the microencapsulated color former is a combination of a basic dye precursor and an organic complexing agent, the appropriate color developer coating contains both an acidic developer material and a transition metal salt.

In all cases, the dry coat weight of the color developer coating typically ranges from about 1 to about 10 grams per square meter, which generally includes from about 0.5 to about 5 grams per square meter of color developer material. In general, there is typically an excess of color developer available to the color former material, or at least 5 to 10 grams of color developer per gram of color former.

The process of the present invention can be incorporated into the printing process in which carbonless paper forms are printed. In this embodiment, an ink jet printhead and the desensitizing ink jet ink are incorporated into the printing apparatus which generates the visible images on the carbonless paper forms. The visible images can be generated by any desired printing process, such as offset printing, electrophotographic printing, ink jet printing, or the like. Prior to, concurrently with, or subsequent to the printing of the visible images on the carbonless paper sheets, the desensitizing ink is applied to selected areas of selected sheets with the ink jet printhead. The completed sheets are subsequently assembled into carbonless paper stacks.

One specific embodiment of the present invention is directed to a printing process which comprises (a) incorporating into an imaging apparatus capable of generating both electrostatic images and ink jet images a carbonless paper set comprising a first sheet, a second sheet, and optional intermediate sheets situated between the first sheet and second sheet, wherein the first sheet comprises paper coated on one surface with a color former and the second sheet comprises paper coated on one surface with a color developer, and wherein, when the carbonless paper set is assembled, the surface of the first sheet coated with the color former is in contact with the surface of a sheet coated with the color developer and the surface of the second sheet coated with the color developer is in contact with the surface of a sheet coated with the color former; (b) generating an electrostatic latent image on an imaging member in the imaging apparatus, developing the latent image with a toner, and contacting the developed image on the imaging member with the first sheet of the carbonless paper set, thereby transferring the developed image to the first sheet; (c) generating an electrostatic latent image on the imaging member in the imaging apparatus, developing the latent image with a toner, and contacting the developed image on the imaging member with the second sheet of the carbonless paper set, thereby transferring the developed image to the second sheet; (d) optionally permanently affixing the transferred images to the first and second sheets; (e) incorporating into the printing apparatus an ink jet ink comprising water, an organic component, and a desensitizing agent capable of interacting either (i) with the color former so that the color former's subsequent ability to interact with the color developer is reduced, or (ii) with the color developer so that the color developer's subsequent ability to interact with the color former is reduced; and (f) causing droplets of the ink containing the desensitizing agent to be ejected in an imagewise pattern onto either (i) at least one surface of one sheet coated with the color former, or (ii) at least one surface of one sheet coated with the color developer.

Another specific embodiment of the present invention is directed to a printing process which comprises (a) incorporating into an ink jet imaging apparatus a carbonless paper set comprising a first sheet, a second sheet, and optional intermediate sheets situated between the first sheet and second sheet, wherein the first sheet comprises paper coated on one surface with a color former and the second sheet comprises paper coated on one surface with a color developer, and wherein, when the carbonless paper set is assembled, the surface of the first sheet coated with the color former is in contact with the surface of a sheet coated with the color developer and the surface of the second sheet coated with the color developer is in contact with the surface of a sheet coated with the color former; (b) incorporating into the printing apparatus an ink jet ink comprising water and a colorant; (c) causing droplets of the ink containing the colorant to be ejected in an imagewise pattern onto at least one surface of the first sheet; (d) causing droplets of the ink containing the colorant to be ejected in an imagewise pattern onto at least one surface of the second sheet; (e) incorporating into the printing apparatus an ink jet ink comprising water, an organic component, and a desensitizing agent capable of interacting either (i) with the color former so that the color former's subsequent ability to interact with the color developer is reduced, or (ii) with the color developer so that the color developer's subsequent ability to interact with the color former is reduced; and (f) causing droplets of the ink containing the desensitizing agent to be ejected in an imagewise pattern onto either (i) at least one surface of one sheet coated with the color former, or (ii) at least one surface of one sheet coated with the color developer.

In a particularly preferred embodiment of the present invention, the printing apparatus employs a thermal ink jet process, wherein the ink is contained in nozzles which are selectively heated in an imagewise pattern, thereby causing droplets of the ink to be ejected in imagewise pattern.

If desired, a selected area of the carbonless paper sheet can be printed more than once with the desensitizing ink to enhance the desensitization process. For example, the sheet can be passed through the printing apparatus twice. Alternatively, two or more printheads containing the desensitizing ink can be included in the printing apparatus so that the paper can be printed at least twice in the same area in a single pass through the apparatus.

Ink jet ink compositions suitable for the printing process of the present invention generally comprise water, a desensitizing agent for carbonless papers, and optional ink additives. Any suitable desensitizing agent can be employed. Examples of suitable desensitizing agents include those disclosed in U.S. Pat. No. 3,852,094, U.S. Pat. No. 3,809,668, U.S. Pat. No. 2,777,780, British Patent Application 2,030,932, Japanese Patent Publication 91-71882, and German Patent 2,727,194, the disclosures of each of which are totally incorporated herein by reference.

Specific examples of suitable desensitizing agents include compounds of the formula

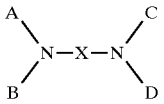

wherein X is a divalent aliphatic or cycloaliphatic radical, preferably an alkylene radical of the formula $$—CH_2CH_2—$$

or $$—CH_2CH_2CH_2—$$

or a cyclic radical, such as cyclopentyl, cyclohexyl, or the like, wherein the nitrogens are substituted 1,2- or 1,3-; A, B, C, and D are selected from hydrogen, aliphatic groups, cycloaliphatic groups, $—CH_2COOH$, and $—CH_2COOR$, with at least one of A, B, C, and D is $—CH_2COOH$ or $—CH_2COOR$, wherein R is aliphatic, preferably a lower alkyl group such as methyl, ethyl, propyl, isopropyl, or butyl, and

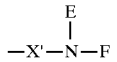

wherein X' is similar to X, E and F are similar to A, B, C, and D; E or F can therefore be another —X—N(E)(F) unit, such that structures of the following type are formed:

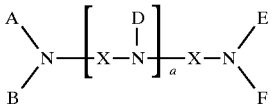

wherein a is 0, 1, 2, 3, 4, or another small integer. Also suitable are polyamines wherein at least one amino group is substituted on a carbon atom which is beta or gamma to a secondary or tertiary nitrogen, e.g., compounds of the formula

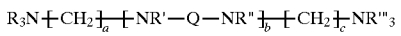

wherein R, R', R", and R" are hydrogen or a suitable aliphatic or cycloaliphatic group, Q is a suitable organic radical, a and c are 2 or 3, and b is 0, 1, 2, 3, 4, 5, 6, 7, 8, 9, or 10, provided that if b=0, a+c is 2 or 3. Also suitable are compounds containing two adjacent carbonyls and/or oxime radicals, i.e., R—(CO)—(CO)—R', R—(CO)—(C=NOH)—R', or R—(C=NOH)—(C=NOH)—R', wherein R and R' are suitable organic radicals such as aliphatic, cycloaliphatic, or aromatic groups. Also suitable are vicinal dimercaptans, i.e., HS—R—SH, wherein R is a 1,2-disubstituted aliphatic, cycloaliphatic, or aromatic group.

Specific examples of suitable desensitizing agents include ethylenediaminetetraacetic acid (EDTA), homologs and analogs of EDTA, tartaric acid, citric acid, nitrilotriacetic acid, triethylenetetraamine, tetramethylethylenediamine, 5-ethyl-5(4-amino-2-azabutyl)-1,9-diamino-3,7-diazanonane, dimethylglyoxime, cyclohexanedione-dioxime, 1,2-dimercaptoethane, 2,3-dimercaptopropanol, partial esters of EDTA as disclosed in U.S. Pat. No. 2,428,353, the disclosure of which is totally incorporated herein by reference, partial esters of trans-cyclohexane-1,2-diaminetetraacetic acid, partial esters of diethylenetriaminepentaacetic acid, partial esters of triethylenetetraaminehexaacetic acid, and the like, such as trimethyl ester monoacid of trans-cyclohexane-1,2-diamine-N,N,N',N'-tetraacetic acid, tetraethyl ester monoacid of diethylenetriamine-N,N,N',N"-pentaacetic acid, trimethyl ester monoacid of EDTA, with preferred degrees of esterification being C-1 or C-2 ester groups, where C is the number of carboxyl radicals in the polycarboxylic acid precursor, and with preferred esterifying agents being alkanols, such as methanol, ethanol, propanol, butanol, and the like. Mixed esters, such as methyl-ethyl, ethyl-butyl, or the like, can also be prepared by conventional ester interchange reactions.

Other examples of suitable desensitizing agents which are particularly useful for desensitizing the electron acceptor color developer coatings of leuco dye color former/acid color developer carbonless systems include cationic quaternary ammonium salts, such as alkyl trimethyl ammonium salts of the general formula $R—N(CH_3)_3X$, where R is any long chain alkyl group higher than octyl and X is an anion such as chloride, bromide, iodide, acetate, or the like, including dodecyl trimethyl ammonium chloride, hexadecyl trimethyl ammonium chloride, octadecyl trimethyl ammonium chloride, soya trimethyl ammonium chloride, and the like, aryl trimethyl ammonium salts of the general formula $R—N(CH_3)_3X$, where R is an aryl group and X is an anion such as chloride, bromide, iodide, acetate, or the like, including benzyl trimethyl ammonium chloride, dialkyl dimethyl ammonium salts of the general formula $R_2N(CH_3)_2Cl$, where R is any long alkyl group higher than the octyl group and X is an anion such as chloride, bromide, iodide, acetate, or the like, including di-coconut dimethyl ammonium chloride, di-hydrogenated tallow dimethyl ammonium chloride, and di-lauryl dimethyl ammonium chloride; higher aliphatic or aryl amine acetates, such as n-dodecylamine acetate, in which the aliphatic or aryl groups are higher than octyl; amines and diamines of high molecular weight, such as dodecyl amine, dodecyl diamine, and the like; substituted oxazolines, such as 2,4,4-trimethyl-2-oxazoline, 2-oleyl-4-hydromethyl-2-oxazoline, and the like; and similar materials.

The desensitizing agent is contained as a component in an ink composition. The ink comprises water, the desensitizing agent, and optional additional ink ingredients, such as one or more organic solvents miscible with water which enhance solubility of the desensitizing agent in the ink, humectants, surfactants, biocides, and the like. The desensitizing agent is present in the ink in any effective amount. In situations where the desensitizer is not highly soluble in the mixture of water and other ink components, the concentration of desensitizing agent may be limited to the amount soluble in the ink. Typical concentrations of desensitizing agent in the ink are at least about 0.5 percent by weight, typically from about 1 to about 40 percent by weight, preferably from about 2 to about 20 percent by weight, more preferably from about 2 to about 10 percent by weight, although the amount can be outside these ranges.

The liquid vehicle of the inks of the present invention may consist of water, or it may comprise a mixture of water and a miscible organic component, such as ethylene glycol, propylene glycol, diethylene glycol, glycerine, dipropylene glycol, polyethylene glycols, polypropylene glycols, amides, such as urea and substituted ureas, ethers, carboxylic acids, esters, alcohols, organosulfides, organosulfoxides, sulfones, alcohol derivatives, carbitol, butyl carbitol, cellusolve, ether derivatives, amino alcohols, ketones, N-methylpyrrolidinone, 2-pyrrolidinone, cyclohexylpyrrolidone, hydroxyethers, amides, sulfoxides, lactones, and other water miscible materials, as well as mixtures thereof. When mixtures of water and water miscible organic liquids are selected as the liquid vehicle, the water to organic ratio may be in any effective range, and typically is from about 100:0 to about 30:70, preferably from about 97:3 to about 50:50, although the ratio can be outside this range. The non-water component of the liquid vehicle generally serves as a humectant which has a boiling point higher than that of water (100° C.). In the inks of the present invention, the liquid vehicle (comprising water plus humectant) is generally present in an amount of from about 60 to about 99.5 percent by weight, and preferably from about 75 to about 99 percent by weight, although the amount can be outside of this range.

Particularly preferred are organic components which enhance solubility of the desensitizing agent in the aqueous liquid vehicle of the ink. Examples of suitable organic components in this instance include ethylene glycol monomethyl ether (available from Union Carbide Corp. as Methyl Cellosolve), diethylene glycol monoethyl ether acetate (available from Union Carbide Corp. as Carbitol acetate), diethylene glycol monobutyl ether (available from Union Carbide Corp. as butyl carbitol), propylene glycol monomethyl ether, dipropylene glycol monomethyl ether, tripropylene glycol monomethyl ether, propylene glycol mono-t-butyl ether, ethylene glycol ethyl ether acetate, ethylene glycol methyl ether acetate, ethylene glycol butyl ether, diethylene glycol butyl ether, diethylene glycol butyl ether acetate, propylene glycol methyl ether acetate, dipropylene glycol methyl ether acetate, tripropylene glycol methyl ether acetate, glycerol, D-sorbitol, ethylene glycol, propylene glycol, propylene carbonate, ethylene carbonate, 1-cyclohexyl-2-pyrrolidone, 1-methyl-2-pyrrolidone, pyrazole, 1,3-dimethyl-2-imidazolidinone, trimethyl phosphate, triethyl phosphate, tributyl phosphate, trioctyl phosphate, tributoxyethyl phosphate, tricresyl phosphate, dimethyl phthalate, diethyl phthalate, dibutyl phthalate, dioctyl phthalate, dialkyl sulfones, dialkyl sulfoxides such as dimethylsulfoxide, aliphatic nitriles, cycloaliphatic nitriles, aromatic nitriles, such as acetonitrile and benzonitrile, aliphatic nitro compounds such as nitromethane, aliphatic methyl ketones, cycloaliphatic methyl ketones, aromatic methyl ketones, anhydrides, such as dimethylformamide and dimethylacetamide, liquid alkanols, such as ethanol, isopropanol, benzyl alcohol, and the like, 2-amino-2-methyl-1-propanol, methyl diethanol amine, phosphoric acid amides of the formula $(R_2N)_3PO$, wherein R is hydrogen or aliphatic, and the like, as well as mixtures thereof. One particularly preferred embodiment is directed to the use of an ink wherein the liquid vehicle comprises water and a mixture of glycerol and diethylene glycol monobutyl ether. Another particularly preferred organic component is dipropylene glycol monomethyl ether acetate, available as Arcosolv DPMA from Arco Chemicals and as Dowanol from Dow Chemical Co. In the embodiment of the present invention wherein the organic component enhances solubility of the desensitizing agent in the ink, typically the organic component is present with respect to water in relative amounts of from about 50 to about 92 percent by weight water and from about 2 to about 50 percent by weight of organic component, although the relative amounts can be outside this range.

Typically the desensitizing ink is not colored, so that the desensitized area of the color developer coating is not apparent to the end user of the carbonless paper set. However, if there is a need to mark the desensitized area, any colorant conventionally used with a thermal ink jet ink can be incorporated in the formulation. Examples of dyes that can be added include those listed in U.S. Pat. No. 5,156,675 (Breton et al.), the disclosure of which is totally incorporated herein by reference. Alternately, the formulation can include a concealed dye, such as those described in U.S. Pat. No. 5,286,280, (Winnik et al.), the disclosure of which is totally incorporated herein by reference, so that the desensitized area would not be visible under normal viewing conditions, but would be readable when the carbonless sheet is exposed to radiation outside the visible wavelength range such as ultraviolet light, in order, for example, to inspect the registration of the printed desensitized area.

Other additives can also be present in the inks. For example, one or more surfactants or wetting agents can be added to the ink. These additives may be of the cationic, anionic, or nonionic types. Suitable surfactants and wetting agents include sodium lauryl sulfate, Tamol® SN, Tamol® LG, those of the Triton® series available from Rohm and Haas Company, those of the Marasperse® series, those of the Igepal® series available from GAF Company, those of the Tergitol® series, and other commercially available surfactants. These surfactants and wetting agents are present in effective amounts, generally from 0 to about 15 percent by weight, and preferably from about 0.01 to about 8 percent by weight, although the amount can be outside of this range.

Polymeric additives can also be added to the inks to enhance the viscosity and the stability of the ink. Water soluble polymers such as Gum Arabic, polyacrylate salts, polymethacrylate salts, polyvinyl alcohols, hydroxypropylcellulose, hydroxyethylcellulose, polyvinylpyrrolidinone, polyvinylether, starch, polysaccharides, and the like are typical polymeric additives. Polymeric additives can be present in the ink of the present invention in amounts of from 0 to about 10 percent by weight, and preferably from about 0.01 to about 5 percent by weight, although the amount can be outside this range.

One example of an additive to the inks is a polymeric additive consisting of two polyalkylene oxide chains bound to a central moiety. This additive is of the formula

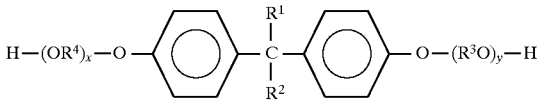

wherein $R^1$ and $R^2$ are independently selected from the group consisting of hydrogen, alkyl groups with from 1 to about 8 carbon atoms, such as methyl, ethyl, propyl, and the like, and alkoxy groups with from 1 to about 8 carbon atoms, such as methoxy, ethoxy, butoxy, and the like, $R^3$ and $R^4$ are independently selected from the group consisting of alkyl groups with from 1 to about 4 carbon atoms, and x and y are each independently a number of from about 100 to about 400, and preferably from about 100 to about 200. Generally, the molecular weight of the polyalkylene oxide polymer is from about 14,000 to about 22,000, and preferably from about 15,000 to about 20,000, although the molecular weight can be outside this range. Materials of this formula are commercially available; for example, Carbowax M20, a polyethylene oxide/bisphenol-A polymer of the above formula with a molecular weight of about 18,000, available from Union Carbide Corporation, Danbury, Conn., is a suitable polymeric additive for the inks of the present invention. In addition, compounds of the above formula can be prepared by the methods disclosed in *Polyethers,* N. G. Gaylord, John Wiley & Sons, New York (1963) and "Laboratory Synthesis of Polyethylene Glycol Derivatives," J. M. Harris, *J. Molecular Science - Rev. Macromol. Chem. Phys.,* C25(3), 325–373 (1985), the disclosures of each of which are totally incorporated herein by reference. The polyalkylene oxide additive is generally present in the ink in an amount of at least about 1 part per million. Typically, the polyalkylene oxide additive is present in amounts of up to 1 percent by weight of the ink, and preferably in amounts of up to 0.5 percent by weight of the ink; larger amounts of the additive may increase the viscosity of the ink beyond the desired level, but larger amounts can be used in applications wherein increased ink viscosity is not a problem. Inks containing these additives are disclosed in U.S. Pat. No. 5,207,825, the disclosure of which is totally incorporated herein by reference.

Other optional additives to the inks include biocides such as Dowicil 150,200, and 75, benzoate salts, sorbate salts, and the like, present in an amount of from about 0.0001 to about 4 percent by weight, and preferably from about 0.01 to about 2.0 percent by weight, pH controlling agents such as acids or, bases, phosphate salts, carboxylates salts, sulfite salts, amine salts, and the like, present in an amount of from 0 to about 1 percent by weight and preferably from about 0.01 to about 1 percent by weight, or the like.

The ink compositions are generally of a viscosity suitable for use in thermal ink jet printing processes. Typically, the ink viscosity is no more than about 5 centipoise, and preferably is from about 1 to about 2.5 centipoise, although the viscosity can be outside this range.

Ink compositions suitable for ink jet printing can be prepared by any suitable process. Typically, the inks are prepared by simple mixing of the ingredients. One process entails mixing all of the ink ingredients together and filtering the mixture to obtain an ink. Inks can be prepared by preparing a conventional ink composition according to any desired process, such as by mixing the ingredients, heating if desired, and filtering, followed by adding any desired additional additives to the mixture and mixing at room temperature with moderate shaking until a homogeneous mixture is obtained, typically from about 5 to about 10 minutes. Alternatively, the optional ink additives can be mixed with the other ink ingredients during the ink preparation process, which takes place according to any desired procedure, such as by mixing all the ingredients, heating if desired, and filtering.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

An ink jet ink containing a desensitizing agent was prepared by adding 60 milliliters of a solution in water of 5 percent by weight tris-phosphate-EDTA disodium salt (obtained from Baker Chemicals) to 40 milliliters of a solution containing 10 milliliters of isopropanol, 15 milliliters of butyl carbitol, 5 milliliters of dipropylene glycol monomethyl ether acetate (Arcosolv DPMA, obtained from Arco Chemicals), 10 milliliters of ethylene glycol. The colorless ink jet ink thus formed had a surface tension of 30.0 dynes per centimeter at 25° C.

The ink thus formed was incorporated into a Hewlett-Packard Deskjet 500C printer, with the yellow ink normally supplied with the printer being removed and replaced with the desensitizing ink. The printhead was capable of generating ink drops of about 75 picoliters in volume. Rectangular solid area patterns were generated using a Windows (Microsoft Corp.) software package onto the color developer sheets of Xerox three-part carbonless paper (obtained from Xerox Canada, Ltd., North York, Ontario), NCR Rally three-part carbonless paper (obtained from Appleton Papers, Incl, Appleton, Wis.), Mead Trans/rite three-part carbonless paper (obtained from Mead Corp., Dayton, Ohio), and Nashua Stallion three-sheet carbonless paper (obtained from Nashua Corp., Nashua, N.H.). The pattern was printed on the carbonless papers using the following printer settings: normal print quality, plain paper mode, color setting at darkest intensity. To test the effectiveness of the desensitizing ink, the pattern was printed at least once on each paper tested. On some of the papers, the procedure was repeated a second time on the same area of the paper. Other papers were treated three times in the same area.

Subsequently, the carbonless papers were assembled into stacks and the treated papers were tested by pressure marking treated and untreated areas of the papers with a ball-point pen. The areas of the papers printed with the desensitizing ink either remained unchanged or became only slightly colored upon application of pressure to the stack, whereas normal carbonless colored images were formed upon application of pressure to the stack in areas untreated with the desensitizing ink. Using this printhead capable of generating ink drops of about 75 picoliters in volume, and using this particular ink, it was observed that maximum desensitizing efficiency was obtained by printing the selected area of the paper twice with the desensitizing ink. No substantial gains in desensitizing efficiency resulted from treating an area of the paper three times.

EXAMPLE II

An ink jet ink containing a desensitizing agent was prepared by adding 60 milliliters of a solution in water of tris-phosphate-EDTA buffer (0.02 Molar EDTA, obtained from Sigma Chemicals) to 40 milliliters of a solution containing 10 milliliters of isopropanol, 15 milliliters of butyl carbitol, 5 milliliters of dipropylene glycol monomethyl ether acetate (Arcosolv DPMA, obtained from Arco Chemicals), and 10 milliliters of ethylene glycol. The colorless ink jet ink thus formed had a surface tension of 30.0 dynes per centimeter at 25° C.

The ink thus formed was incorporated into a Hewlett-Packard Deskjet 500C printer, with the yellow ink normally supplied with the printer being removed and replaced with the desensitizing ink. The printhead was capable of generating ink drops of about 75 picoliters in volume. Rectangular solid area patterns were generated using a Windows (Microsoft Corp.) software package onto the color developer sheets of Xerox three-part carbonless paper (obtained from Xerox Canada, Ltd., North York, Ontario), NCR Rally three-part carbonless paper (obtained from Appleton Papers, Inc., Appleton Wis.), Mead Trans/rite three-part carbonless paper (obtained from Mead Corp., Dayton OH), and Nashua Stallion three-part carbonless paper (obtained from Nashua Corp., Nashua N.H.). The pattern was printed on the carbonless papers using the following printer settings: normal print quality, plain paper mode, color setting at darkest intensity. To test the effectiveness of the desensitizing ink, the pattern was printed at least once on each paper tested. On some of the papers, the procedure was repeated a second time on the same area of the paper. Other papers were treated three times in the same area.

Subsequently, the carbonless papers were assembled into stacks and the treated papers were tested by pressure marking treated and untreated areas of the papers with a ball-point pen. The areas of the papers printed with the desensitizing ink became only slightly colored upon application of pressure to the stack, whereas normal carbonless colored images were formed upon application of pressure to the stack in areas untreated with the desensitizing ink.

Other embodiments and modifications of the present invention may occur to those skilled in the art subsequent to a review of the information presented herein, these embodiments and modifications, as well as equivalents thereof, are also included within the scope of this invention.

What is claimed is:

1. A printing process which comprises (a) incorporating into a thermal ink jet printing apparatus having nozzles for containing ink a carbonless paper set comprising a first sheet, a second sheet, and optional intermediate sheets situated between the first sheet and second sheet, wherein the first sheet comprises paper coated on one surface with a color former and the second sheet comprises paper coated on one surface with a color developer, and wherein, when the carbonless paper set is assembled, the surface of the first sheet coated with the color former is in contact with the surface of a sheet coated with the color developer and the surface of the second sheet coated with the color developer is in contact with the surface of a sheet coated with the color former; (b) incorporating into the printing apparatus a desensitizing material comprising water, an organic component, and a desensitizing agent capable of interacting either (i) with the color former so that the color former's subsequent ability to interact with the color developer is reduced, or (ii) with the color developer so that the color developer's subsequent ability to interact with the color former is reduced; and (c) selectively heating the desensitizing material in the nozzles in an imagewise pattern, thereby causing droplets of the desensitizing material to be ejected in an imagewise pattern onto either (i) at least one surface of one sheet coated with the color former, or (ii) at least one surface of one sheet coated with the color developer.

2. A printing process according to claim 1 wherein the desensitizing material contains a desensitizing agent selected from the group consisting of

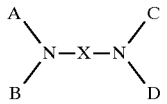

wherein X is a divalent aliphatic or cycloaliphatic radical, A, B, C, and D are each independently selected from hydrogen, aliphatic groups, cycloaliphatic groups, —$CH_2COOH$, and —$CH_2COOR$, wherein R is an aliphatic group, wherein at least one of A, B, C, and D is —$CH_2COOH$ or —$CH_2COOR$;

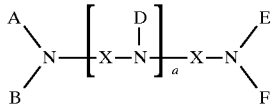

wherein a is 1, 2, 3, or 4, X is a divalent aliphatic or cycloaliphatic radical, A, B, D, E, and F are each independently selected from hydrogen, aliphatic groups, cycloaliphatic groups, —$CH_2COOH$, and —$CH_2COOR$, wherein R is an aliphatic group, wherein at least one of A, B, C, D, and E is —$CH_2COOH$ or —$CH_2COOR$;

$$R_3N\text{-}[CH_2]_a\text{-}[NR'\text{-}Q\text{-}NR'']_b\text{-}[CH_2]_c\text{-}NR'''_3$$

wherein R, R', R", and R"' are each independently selected from the group consisting of hydrogen, aliphatic groups, and cycloaliphatic groups, Q is an organic radical, a and c are each 2 or 3, and b is 0, 1, 2, 3, 4, 5, 6, 7, 8, 9, or 10, provided that if b=0, a+cis 2 or 3;

R—(CO)—(CO)—R' wherein R and R' are each organic radicals;

R—(CO)—(C=NOH)—R' wherein R and R' are each organic radicals;

R—(C=NOH)—(C=NOH)—R' wherein R and R' are each organic radicals;

HS—R—SH wherein R is selected from the group consisting of 1,2-disubstituted aliphatic groups, 1,2-disubstituted cycloaliphatic groups, and aromatic groups; and mixtures thereof.

3. A printing process according to claim 1 wherein the desensitizing material contains a desensitizing agent selected from the group consisting of ethylenediaminetetraacetic acid, tartaric acid, citric acid, nitrilotriacetic acid, triethylenetetraamine, tetramethylethylenediamine, 5-ethyl-5(4-amino-2-azabutyl)-1,9-diamino-3,7-diazanonane, dimethylglyoxime, cyclohexanedione-dioxime, 1,2-dimercaptoethane, 2,3-dimercaptopropanol, trimethyl ester monoacid of trans-cyclohexane-1,2-diamine-N,N,N',N'-tetraacetic acid, tetraethyl ester monoacid of diethylenetriamine-N,N,N',N"-pentaacetic acid, trimethyl ester monoacid of EDTA, and mixtures thereof.

4. A printing process according to claim 1 wherein the desensitizing material contains a desensitizing agent selected from the group consisting of alkyl trimethyl ammonium salts, aryl trimethyl ammonium salts, dialkyl dimethyl ammonium salts, aliphatic amine acetates in which the aliphatic groups are higher than octyl, aryl amine acetates in which the aryl groups are higher than octyl, substituted oxazolines, and mixtures thereof.

5. A printing process according to claim 1 wherein the desensitizing material contains a desensitizing agent selected from the group consisting of dodecyl trimethyl ammonium salts, hexadecyl trimethyl ammonium salts, octadecyl trimethyl ammonium salts, soya trimethyl ammonium salts, benzyl trimethyl ammonium salts, di-coconut dimethyl ammonium salts, di-hydrogenated tallow dimethyl ammonium salts, di-lauryl dimethyl ammonium salts, n-dodecylamine acetate, dodecyl amine, dodecyl diamine, 2,4,4-trimethyl-2-oxazoline, 2-oleyl-4-hydromethyl-2-oxazoline, and mixtures thereof.

6. A printing process according to claim 1 wherein the desensitizing agent in the desensitizing material is ethylenediaminetetraacetic acid.

7. A printing process according to claim 1 wherein the desensitizing agent is present in the desensitizing material in an amount of at least about 0.5 percent by weight.

8. A printing process according to claim 1 wherein the desensitizing agent is present in the desensitizing material in an amount of from about 1 to about 40 percent by weight.

9. A printing process according to claim 1 wherein the desensitizing agent is present in the desensitizing material in an amount of from about 2 to about 20 percent by weight.

10. A printing process according to claim 1 wherein the desensitizing agent is present in the desensitizing material in an amount of from about 2 to about 10 percent by weight.

11. A printing process according to claim 1 wherein the organic component in the desensitizing material is selected from the group consisting of ethylene glycol monomethyl ether, diethylene glycol monoethyl ether acetate, diethylene glycol monobutyl ether, propylene glycol monomethyl ether, dipropylene glycol monomethyl ether, tripropylene glycol monomethyl ether, propylene glycol mono-t-butyl ether, ethylene glycol ethyl ether acetate, ethylene glycol methyl ether acetate, ethylene glycol butyl ether, diethylene glycol butyl ether, diethylene glycol butyl ether acetate, propylene glycol methyl ether acetate, dipropylene glycol methyl ether acetate, tripropylene glycol methyl ether acetate, glycerol, D-sorbitol, ethylene glycol, propylene glycol, propylene carbonate, ethylene carbonate, 1-cyclohexyl-2-pyrrolidone, 1-methyl-2-pyrrolidone, pyrazole, 1,3-dimethyl-2-imidazolidinone, trimethyl phosphate, triethyl phosphate, tributyl phosphate, trioctyl phosphate, tributoxyethyl phosphate, tricresyl phosphate, dimethyl phthalate, diethyl phthalate, dibutyl phthalate, dioctyl phthalate, dialkyl sulfones, dialkyl sulfoxides, aliphatic nitriles, cycloaliphatic nitriles, aromatic nitriles, aliphatic nitro compounds, aliphatic methyl ketones, cycloaliphatic methyl ketones, aromatic methyl ketones, anhydrides, liquid alkanols, 2-amino-2-methyl-1-propanol, methyl diethanol amine, phosphoric acid amides of the formula $(R_2N)_3PO$, wherein R is hydrogen or aliphatic, and mixtures thereof.

12. A printing process according to claim 1 wherein the organic component in the desensitizing material is selected from the group consisting of ethylene glycol monomethyl ether, diethylene glycol monoethyl ether acetate, diethylene glycol monobutyl ether, propylene glycol monomethyl ether, dipropylene glycol monomethyl ether, tripropylene glycol monomethyl ether, propylene glycol mono-t-butyl ether, ethylene glycol ethyl ether acetate, ethylene glycol methyl ether acetate, ethylene glycol butyl ether, diethylene glycol butyl ether, diethylene glycol butyl ether acetate, propylene glycol methyl ether acetate, dipropylene glycol methyl ether acetate, tripropylene glycol methyl ether acetate, glycerol, D-sorbitol, ethylene glycol, propylene glycol, diethylene glycol, liquid alkanols, and mixtures thereof.

13. A printing process according to claim 1 wherein the organic component in the desensitizing material comprises glycerol and diethylene glycol monobutyl ether.

14. A printing process according to claim 1 wherein the organic component in the desensitizing material comprises dipropylene glycol monomethyl ether acetate.

15. A printing process according to claim 1 wherein the organic component in the desensitizing material is present in an amount by weight such that the ratio of water to organic component is from about 98:2 to about 50:50.

16. A printing process according to claim 1 wherein the organic component in the desensitizing material is selected from the group consisting of ethylene glycol monomethyl ether, diethylene glycol monoethyl ether acetate, diethylene glycol monobutyl ether, propylene glycol monomethyl ether, dipropylene glycol monomethyl ether, tripropylene glycol monomethyl ether, propylene glycol mono-t-butyl ether, ethylene glycol ethyl ether acetate, ethylene glycol methyl ether acetate, ethylene glycol butyl ether, diethylene glycol butyl ether, diethylene glycol butyl ether acetate, propylene glycol methyl ether acetate, dipropylene glycol methyl ether acetate, tripropylene glycol methyl ether acetate, glycerol, D-sorbitol, ethylene glycol, propylene glycol, propylene carbonate, ethylene carbonate, 1-cyclohexyl-2-pyrrolidone, 1-methyl-2-pyrrolidone, pyrazole, 1,3-dimethyl-2-imidazolidinone, trimethyl phosphate, triethyl phosphate, tributyl phosphate, trioctyl phosphate, tributoxyethyl phosphate, tricresyl phosphate, dimethyl phthalate, diethyl phthalate, dibutyl phthalate, dioctyl phthalate, dialkyl sulfones, dialkyl sulfoxides, aliphatic nitriles, cycloaliphatic nitriles, aromatic nitriles, aliphatic nitro compounds, aliphatic methyl ketones, cycloaliphatic methyl ketones, aromatic methyl ketones, anhydrides, methyl diethanol amine, phosphoric acid amides of the formula $(R_2N)_3PO$, wherein R is hydrogen or aliphatic, and mixtures thereof.

17. A printing process according to claim 1 wherein the organic component in the desensitizing material is selected from the group consisting of ethylene glycol monomethyl ether, diethylene glycol monoethyl ether acetate, diethylene glycol monobutyl ether, propylene glycol monomethyl ether, dipropylene glycol monomethyl ether, tripropylene glycol monomethyl ether, propylene glycol mono-t-butyl ether, ethylene glycol ethyl ether acetate, ethylene glycol methyl ether acetate, ethylene glycol butyl ether, diethylene glycol butyl ether, diethylene glycol butyl ether acetate, propylene glycol methyl ether acetate, dipropylene glycol methyl ether acetate, tripropylene glycol methyl ether acetate, glycerol, D-sorbitol, ethylene glycol, propylene glycol, diethylene glycol, and mixtures thereof.

18. A printing process according to claim 1 wherein the desensitizing material is applied at least twice to a selected area of either (i) at least one surface of one sheet coated with the color former, or (ii) at least one surface of one sheet coated with the color developer.

19. A printing process which comprises (a) incorporating into an imaging apparatus capable of generating both electrostatic images and thermal ink jet images a carbonless paper set comprising a first sheet, a second sheet, and optional intermediate sheets situated between the first sheet and second sheet, wherein the first sheet comprises paper coated on one surface with a color former and the second sheet comprises paper coated on one surface with a color developer, and wherein, when the carbonless paper set is assembled, the surface of the first sheet coated with the color former is in contact with the surface of a sheet coated with the color developer and the surface of the second sheet coated with the color developer is in contact with the surface of a sheet coated with the color former; (b) generating an electrostatic latent image on an imaging member in the imaging apparatus, developing the latent image with a toner, and contacting the developed image on the imaging member with the first sheet of the carbonless paper set, thereby transferring the developed image to the first sheet; (c) generating an electrostatic latent image on the imaging member in the imaging apparatus, developing the latent image with a toner, and contacting the developed image on the imaging member with the second sheet of the carbonless paper set, thereby transferring the developed image to the second sheet; (d) optionally permanently affixing the transferred images to the first and second sheets; (e) incorporating into ink nozzles in the printing apparatus a desensitizing material comprising water, an organic component, and a desensitizing agent capable of interacting either (i) with the color former so that the color former's subsequent ability to interact with the color developer is reduced, or (ii) with the color developer so that the color developer's subsequent ability to interact with the color former is reduced; and (f) selectively heating the desensitizing material in the nozzles in an imagewise pattern, thereby causing droplets of the desensitizing material to be ejected in an imagewise pattern onto either (i) at least one surface of one sheet coated with the color former, or (ii) at least one surface of one sheet coated with the color developer.

20. A printing process which comprises (a) incorporating into a thermal ink jet imaging apparatus having nozzles for containing ink a carbonless paper set comprising a first sheet, a second sheet, and optional intermediate sheets situated between the first sheet and second sheet, wherein the first sheet comprises paper coated on one surface with a color former and the second sheet comprises paper coated on one surface with a color developer, and wherein, when the carbonless paper set is assembled, the surface of the first sheet coated with the color former is in contact with the surface of a sheet coated with the color developer and the surface of the second sheet coated with the color developer is in contact with the surface of a sheet coated with the color former; (b) incorporating into the printing apparatus an ink jet ink comprising water and a colorant; (c) selectively heating the ink containing the colorant in the nozzles in an imagewise pattern, thereby causing droplets of the ink containing the colorant to be ejected in an imagewise pattern onto at least one surface of the first sheet; (d) selectively heating the ink containing the colorant in the nozzles in an imagewise pattern, thereby causing droplets of the ink containing the colorant to be ejected in an imagewise pattern onto at least one surface of the second sheet; (e) incorporating into the printing apparatus a desensitizing material comprising water, an organic component, and a desensitizing agent capable of interacting either (i) with the color former so that the color former's subsequent ability to interact with the color developer is reduced, or (ii) with the color developer so that the color developer's subsequent ability to interact with the color former is reduced; and (f) selectively heating the desensitizing material in the nozzles in an imagewise pattern, thereby causing droplets of the ink containing the desensitizing agent to be ejected in an imagewise pattern onto either (i) at least one surface of one sheet coated with the color former, or (ii) at least one surface of one sheet coated with the color developer.

* * * * *